US005101649A

United States Patent [19]

Duval

[11] Patent Number: 5,101,649

[45] Date of Patent: Apr. 7, 1992

[54] KEY-OPERABLE LOCK WITH REMOVABLE PLUG

[75] Inventor: Robert A. Duval, Fitchburg, Mass.

[73] Assignee: Rad Lock Inc., Worcester, Mass.

[21] Appl. No.: 431,034

[22] Filed: Nov. 2, 1989

[51] Int. Cl.[5] ..... E05B 29/04

[52] U.S. Cl. ..... 70/369; 70/421

[58] Field of Search ..... 70/367-379, 70/375, 421, 371

[56] References Cited

U.S. PATENT DOCUMENTS

| | | | |
|---|---|---|---|
| 1,805,891 | 5/1931 | Shinn . | |
| 1,905,639 | 4/1933 | Jacobi . | |
| 1,908,672 | 5/1933 | Jacobi . | |
| 2,061,456 | 11/1936 | Falk . | |
| 2,065,683 | 12/1936 | Gahagan | 70/369 |
| 2,097,190 | 10/1937 | Jacobi | 70/368 |
| 2,677,266 | 5/1954 | Hagstrom . | |
| 4,009,599 | 3/1977 | Patriquin | 70/371 X |
| 4,272,975 | 6/1981 | Patriquin | 70/371 X |
| 4,398,405 | 8/1983 | Patriquin . | |
| 4,416,129 | 11/1983 | Thimot | 70/369 |

*Primary Examiner*—Lloyd A. Gall

[57] ABSTRACT

A key-operable lock having a releasable plug which is rotatable from a locked condition to an unlocked condition. The plug is removable from a fixed mounting member only in the unlocked condition and is blocked for removal in the locked condition by the combined effects of a master key-operable tumbler which is slideable in the plug and a boss which is fixed to the plug. In the locked condition, the boss and one end portion of the control tumbler extend outwardly from the plug to engage a fixed mounting member and the diametrically opposite end portion of the tumbler is inside of the plug. When a master key is inserted into the lock and the plug is rotated to the unlocked position both end portions of the control tumbler are inside of the plug; the boss is aligned with a slot of the mounting member and the plug is free to be removed from the fixed mounting member.

2 Claims, 2 Drawing Sheets

KEY-OPERABLE LOCK WITH REMOVABLE PLUG

BACKGROUND OF THE INVENTION

This invention relates to a key-operable lock with a removable plug.

Key-operable locks with removable plugs are commonly used for locking desks, cabinets and the like. They are desirable because they simplify lock repairs and changes in key combinations. The locks generally comprise a fixed mounting member, a plug which is rotatable between a locked condition and an unlocked condition in the mounting member, a plug extension, a plurality of spring biased tumblers which are slideable in the plug between the locked condition and the unlocked condition, a standard key for locking and unlocking the plug and a special key for removing the plug. In the locked condition, one end portion of each of the tumblers extends outwardly from the plug to rotatively lock the plug to the mounting member. One of the tumblers is a control tumbler which blocks axial removal of the plug in the absence of the special key.

When the standard key is inserted into the plug, except for the control tumbler, the key engages the tumblers and shifts the outwardly extending ends of the tumblers inwardly to free the plug for rotation in the mounting member. The control tumbler continues to engage the mounting member to block its removal from the mounting member. When the master key is inserted in place of the standard key, the master key shifts the outwardly extending end of control tumbler inwardly to disengage the mounting member. This may or may not allow removal of the plug from the mounting member. In some cases the lock must be in the unlocked condition for removal of the plug from the mounting member.

The characteristic which distinguishes the locks of the relevant art is the relationship of the control tumbler relative to the plug in the locked and unlocked conditions.

Shinn U.S. Pat. No. 1,805,891; Falk U.S. Pat. No. 2,061,456; and Patriquin U.S. Pat. No. 4,398,405 are exemplary of the relevant art of key-operable locks with removable plugs. All rely on a single element which is movable with respect to the plug, i.e., a control tumbler to block the removal of the plug from the mounting member.

Shinn is a key-operable lock having a plug which is removable in either the locked or unlocked conditions. In the locked condition one end portion of the control tumbler extends outwardly from the plug and engages a fixed mounting member. The diametrically opposite end portion is always inside of the plug. When a special key is inserted, the outward extending end is retracted into the plug to allow removal of the plug in either the locked or unlocked conditions.

Falk is a key-operable lock having a plug which is removable only in the unlocked condition. In the locked condition, one end portion of the control tumbler extends outwardly from the plug and engages a fixed mounting member. The diametrically opposite end is always inside of the plug. When a standard key is inserted into the plug, the control tumbler is partially retracted into the plug but continues to block removal of the plug from the mounting member. When a special key is inserted, the outward extending end is further retracted to block removal of the plug in the locked condition but allows removal of the plug in the unlocked condition.

Patriquin discloses a key-operable lock having a plug which, like Falk, is removable only in the unlocked condition. In the locked condition, one end portion of the control tumbler extends outwardly from the plug and engages the mounting member. When a special key is inserted, the outwardly extending end of the control tumbler is retracted inside of the plug and the diametrically opposite end portion is projected outwardly from the plug to block removal of the plug in the locked condition but allow removal of the plug in the unlocked condition.

One deficiency of Shinn, Falk and Patriquin is that only one outwardly projecting end of the control tumbler prevents its forced removal from the plug by an unauthorized person.

Another deficiency of Shinn is that an unauthorized person can remove the cylinder from the mounting member in the unlocked condition with a lock pick.

Another deficiency of Patriquin is that the length of the control tumbler must be longer than Shinn and Falk because the end of the tumbler must extend out of the tumbler in the unlocked condition.

SUMMARY OF THE INVENTION

The present invention is a key-operable lock having a plug which is removable only in an unlocked condition and blocked for removal in the locked condition by the combined effects of one end of a control tumbler and a boss which is fixed to the plug.

In the locked condition, one end of the control tumbler extends outwardly from the plug and the diametrically opposite end portion is inside of the plug. When a master key is inserted into the plug both ends of the control tumbler are inside of the plug. When the plug is rotated to the unlocked condition with the master key the plug is free for removal from the lock.

The primary object of the invention resides in providing in a key-operable lock a removable plug which cannot be removed by unauthorized persons.

Another object of the invention resides in providing in a key-operable lock a plug which is blocked from removal in the the locked condition by combination of an element which is fixed to the plug and an element which is movable with respect to the plug.

One benefit of the invention is that the outwardly extending boss which is fixed to the plug prevents plug removal in the locked condition with a lock pick.

Another benefit of the invention is that a substantially increased force is required for an unauthorized person to forcibly extract the plug from the mounting member.

Further objects, benefits and features will be apparent from the ensuing description and accompanying drawings which disclose the invention in detail. The best mode contemplated in practicing the invention is disclosed and the subject matter in which exclusive rights are claimed is set forth in each of the numbered claims at the conclusion of the detailed description.

DETAILED DESCRIPTION OF THE PREFERRED EMBODIMENT

Figure 3:
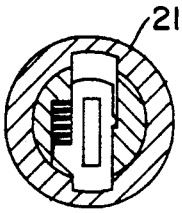
FIG. 3 a cross-sectional view taken on the line 3—3 of FIG. 2.
Figure 1:
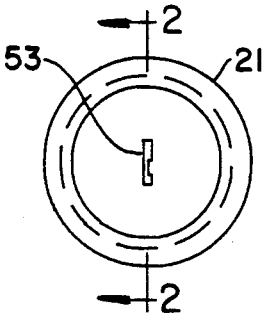
FIG. 1 is a front view of a key-operable lock having a removable plug which embodies the present invention.

Referring now to the drawings wherein like numerals designate like and corresponding parts throughout the several views, a key-operable lock 20, generally denoted by the numeral 20, is illustrated therein which is comprised of a mounting member 21, a plug 22 mounted in the mounting member 21, a plurality of tumblers 23 mounted in the plug 22, and a plug extension 24. The plug extension 24 is a generally cylindrical member which is removably keyed to the plug 22 by engaging a square projection 25 at the rearward end of the plug 22 with a square recess 26 in the forward end of the plug extension 24. The plug extension 24 is rotatable with the plug 22 in the mounting member 21 between a locked condition and an unlocked condition of the mounting member 21. Suitably attached to the end of the plug extension 24 is a pawl 24*a* which is restricted to move between the locked and unlocked conditions.

At the forward end of the mounting member 21 there is a circular flange 27 that abuts the surface of an article 28 to which the lock 20 is applied, by way of example, the drawer of a desk or the door of a cabinet. The mounting member 21 is non-rotatable and is secured to the article 28 by inserting the lock 20 through an aperture 29 of the article 28 and threadably engaging a nut 30 with the outer portion of the mounting member 21.

An axial bore 32 extends from the front face of the mounting member 21 through the mounting member 21 to a first shoulder 33 where it is reduced in size; thence to a second shoulder 34 where it is further reduced in size; and thence to a third shoulder 35 where it is again reduced in size. Just rearward of the third shoulder 35 there is an annular recess 36 which cooperates with a control tumbler 42 and a fixed boss 52 of the plug 22 to block removal of the plug 22 in the locked condition and allow removal of the plug 22 in the unlocked condition.

Inside of the bore 32 at 12:00 and 6:00 o'clock are an upper groove 37 and a lower longitudinal groove 38. The upper groove 37 extends inwardly from the first shoulder 33 to the second shoulder 34 and the lower groove 38 extends from the first shoulder 33 into the annular recess 36 where it forms a slot 38*a* having a width which is less than the forward portion of the lower groove 38 whereby the outwardly extending end 50 of the control tumbler 42 blocks removal of the plug 22 in the locked condition and the fixed boss 52 does not block removal of the plug 22 in the unlocked condition.

The plug 22 is a generally cylindrical member and has an enlarged front portion which abuts the first shoulder 33. Inside of the bore 32 an enlarged front portion of the plug extension 24 abuts the third shoulder 35. Extending transversely through the plug 22 there is a plurality of transverse slideways 41 which receive the tumblers 23. The innermost tumbler is the control tumbler 42 which is aligned with the annular recess 36 and cooperates with the fixed boss 52 to block removal of the plug 22 in the locked condition and to allow removal of the plug 22 in the unlocked condition.

With reference to FIG. 3, each of the tumblers 23 has a pair of side bars 43, an upper bar 44, and a lower bar 45 which together form a central slot 46 through which a key 47 may pass. On one sidebar 43 there is a projection 48 which supports a coil spring 49 for biasing the tumbler to lock the plug 22 in the locked condition against rotation in the mounting member 21. The other end portion of the spring 49 bears against a surface of the plug 22.

Figure 2:
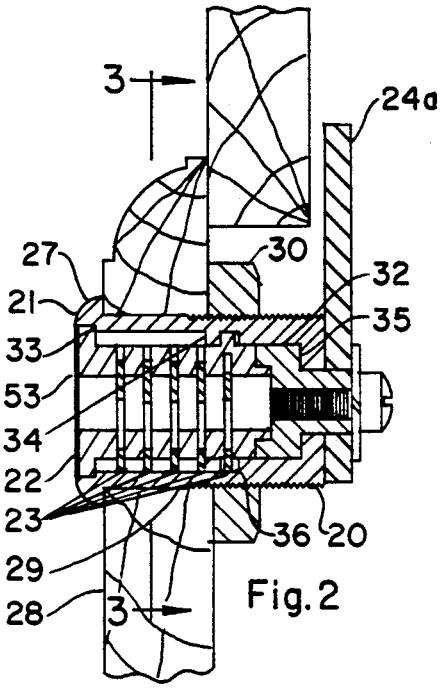
FIG. 2 is a cross-sectional view taken on the line 2—2 of FIG. 1 showing the lock in a locked condition mounted in a cabinet door.

In the locked condition the lower side bar 45 of each tumbler 23 is forced outwardly by the spring 49 and extends out of the plug 22. As shown in FIGS. 2 and 3, the outward extending end 50 of the control tumbler 42 engages the annular recess 36 and the outward extending ends 51 of the other tumblers 23 engage the longitudinal groove 38 at 6:00 o'clock. Thus, in the locked condition, the plug 22 is fixed to the mounting member 21 against rotation or removal from the mounting member 21.

At the inner end of the plug 22 and diametrically opposite the outward extending end 50 of the control tumbler 42 there is a boss 52 which is preferably integral with the plug 22 but may be optionally fixedly attached to the plug 22. The boss 52 extends into the annular recess 36 and cooperates with the end 50 of the control tumbler 42 to block removal of the plug 22 from the mounting member 21 in the locked condition.

Figure 4:
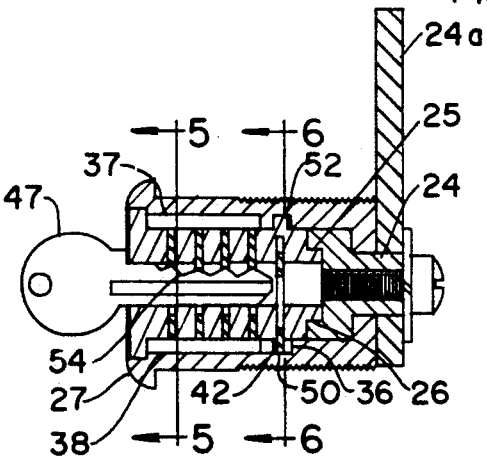
FIG. 4 cross-sectional view of the lock taken in the same manner as FIG. 2 showing a standard key inserted into the plug.
Figure 5:
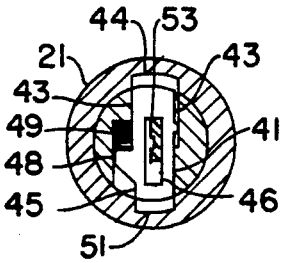
FIG. 5 is a cross-sectional view taken on the line 5—5 of FIG. 4.
Figure 6:
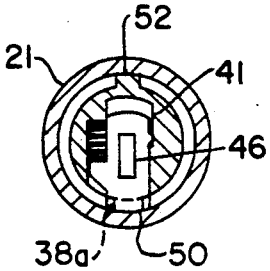
FIG. 6 is a cross-sectional view taken on the line 6—6 of FIG. 4.

Extending through the center of the plug 22 there is a key slot 53 for receiving a key. When a standard key 47 is inserted into the key slot 53, as shown in FIG. 4, the notched portions 54 of the key 47 engage the upper bars 44 of the locking tumblers 57 to depress the springs 49 and shift the lower ends 51 of the tumblers 57 shifted upwardly out of the lower longitudinal groove 38 to free the plug 22 for rotation with the key 47 to the unlocked condition.

When the key 47 is removed from the cylinder 22 in the unlocked condition, the ends 51 of the tumblers 57 are extended outwardly and engage the upper groove 37. It will be observed that the standard key 47 is too short to engage the control tumbler 42 and disengage the outward extending end 50 with the annular recess 36 in either the locked or unlocked conditions.

Figure 7:
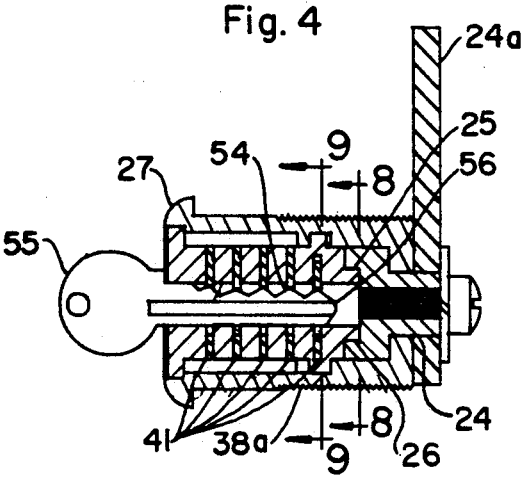
FIG. 7 is a cross-sectional view of the lock taken in the same manner as FIG. 2 showing a standard key inserted into the plug.
Figure 8:
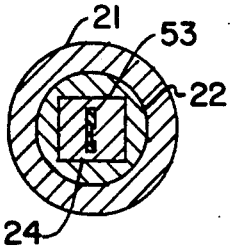
FIG. 8 a cross-sectional view taken on the line 8—8 of FIG. 7.
Figure 9:
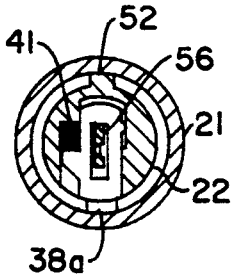
FIG. 9 a cross-sectional view taken on the line 9—9 of FIG. 7.
Figure 10:
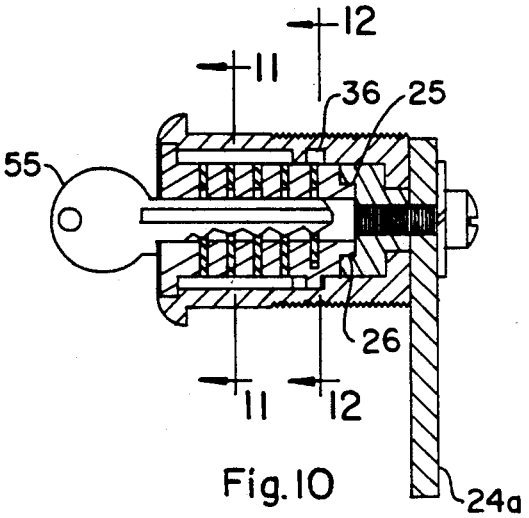
FIG. 10 a cross-sectional view which is similar to FIG. 7 except that the lock is in the unlocked condition.
Figure 11:
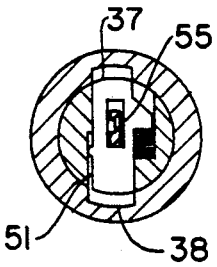
FIG. 11 a cross-sectional view taken on the line 11—11 of FIG. 10.
Figure 12:
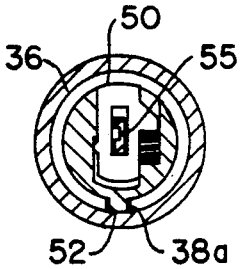
FIG. 12 a cross-sectional view taken on the line 12—12 of FIG. 10.

With reference to FIGS. 7 and 9, when a longer master key 55 with the same notched portions 54 as the standard key 47 is inserted into key slot 53 in the locked condition, the end portion 56 of the key 55 shifts the control tumbler 42 upward out of the annular recess 36. However, the plug 22 cannot be removed from the mounting member 21 in the locked condition because the boss 52 at the innermost end of the plug 22 is engaged with the annular recess 36 of the mounting member 21.

When the plug 22 is rotated to the unlocked condition with the master key 55, the boss 52 is aligned with the slot 38*a* of the lower longitudinal groove 38 of the mounting member 21 and the plug 22 is free to be withdrawn from the lock 20. When the plug 22 is withdrawn from the lock 20 the plug extension 24 is disengaged from the plug 22 and remains in the mounting member 21.

Figure 13:
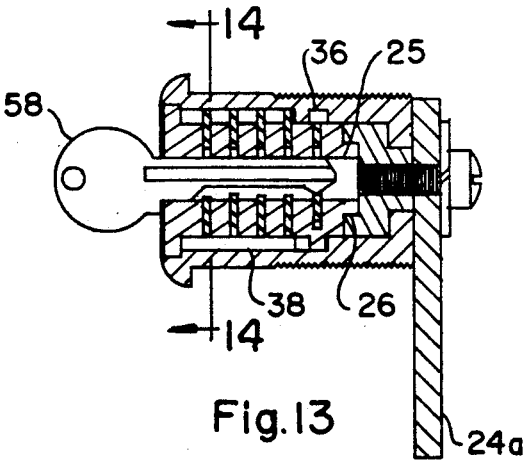
FIG. 13 is a cross-sectional view taken in the same manner as FIG. 10 showing an alternate embodiment.
Figure 14:
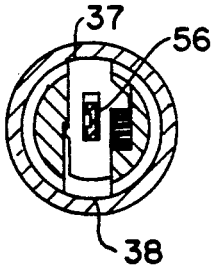
FIG. 14 a cross-sectional view taken on the line 14—14 of FIG. 13.

In FIGS. 13 and 14 an alternate master key 58 is shown which does not have the notched portions 54 of the first embodiment. The alternate key 58 cooperates with the standard key 47 and longitudinal groove 38 to provide a single master key 58 for plug removal. The standard key 47 must first be used to rotate the plug 22 to the unlocked condition. With reference to FIGS. 13 and 14, it will be observed that when the alternate master key 58 is inserted into the cylinder 22, the ends 51 of the tumblers engage the upper groove 37 of the plug 22. The alternate key 58 cooperates with the control tumbler 42 in the unlocked condition to allow removal of the plug 22 from the mounting member 21.

From the foregoing it will be appreciated that my invention provides in a key-operable lock with a plug which is removable only in the unlocked condition substantially greater protection against removal of the plug by unauthorized persons.

Although but several embodiments of my invention have been described, it will be understood that other embodiments can be derived from my description by changes in the size, shape, material and substitution of parts without departing from the spirit thereof.

I claim:

1. A key-operable lock with a removable plug, comprising in combination: a mounting member, said member having a bore extending through said member, an annular recess in said bore, a pair of diametrically opposite longitudinal grooves in said bore, the first of said grooves intersecting said annular recess; a plug mounted for rotation between a locked position whereat said plug is locked to said mounting member and an unlocked position 180 degrees from said locked position whereat said plug may be removed from said member, said plug having a plurality of transverse slideways centered in the plug for receiving a plurality of locking tumblers; a plurality of key-operable locking tumblers mounted in said transverse slideways, each tumbler being resiliently biased to extend an end portion thereof outwardly from said plug to engage the first of said grooves when the lock is in a locked condition; a key-operable control tumbler mounted in one of said slideways which is resiliently biased to extend an end portion thereof outwardly of said plug in the same direction to said outward extending ends of said locking tumblers to engage said annular recess and prevent removal of said plug with a standard key; a standard key which is insertable into said plug to unlock said plug by retracting the outward extending ends of said locking tumblers from said first groove; a member fixed to said plug for allowing removal of said plug only in said unlocked position, said fixed member being 180 degrees apart from said first longitudinal groove in said locked condition and aligned with said first longitudinal groove in said unlocked position; a master key which acts only on said control tumbler to displace and disengage said control tumbler from said annular recess in said unlocked position and allow removal of said plug in said unlocked position.

2. The lock recited in claim 1 wherein said member which is fixed to said plug is integral with said plug.

* * * * *